United States Patent [19]

Jacobsson

[11] 4,068,807

[45] Jan. 17, 1978

[54] THREAD SUPPLY DEVICE

[75] Inventor: Kurt Arne Gunnar Jacobsson, Ulricehamn, Sweden

[73] Assignee: Aktiebolaget IRO, Ulricehamn, Sweden

[21] Appl. No.: 724,918

[22] Filed: Sept. 20, 1976

[30] Foreign Application Priority Data

Sept. 25, 1975 Germany ..... 2542824

[51] Int. Cl.[2] ..... B65H 51/00; B65H 51/20

[52] U.S. Cl. ..... 242/47.01; 242/47.12; 139/224 A

[58] Field of Search ..... 242/47.01–47.12, 242/128, 129.8, 156, 156.2, 147; 254/135 R, 145, 150 R, 175.3–175.7; 139/224 R, 224 A, 450, 452

[56] References Cited

U.S. PATENT DOCUMENTS

| | | | |
|---|---|---|---|
| 2,242,053 | 5/1941 | Chapman, Sr. | 242/128 |
| 3,411,548 | 11/1968 | Pfarrwaller | 139/452 |
| 3,419,225 | 12/1968 | Rosen | 242/47.12 |
| 3,490,710 | 1/1970 | Mühlhäusler | 242/47.01 |

*Primary Examiner*—Leonard D. Christian

*Attorney, Agent, or Firm*—Blanchard, Flynn, Thiel, Boutell & Tanis

[57] ABSTRACT

A device for supplying a textile or metallic thread to a processing device. The thread issuing from a storage bobbin is wound tangentially on a storage body and is unwound endwise therefrom beneath a resilient brake ring which abuts a conical support surface on the storage body. The brake ring can be adjusted in the axial direction of the storage body relative to the support surface by means of an adjusting means which can be actuated in response to the thread tension.

11 Claims, 1 Drawing Figure

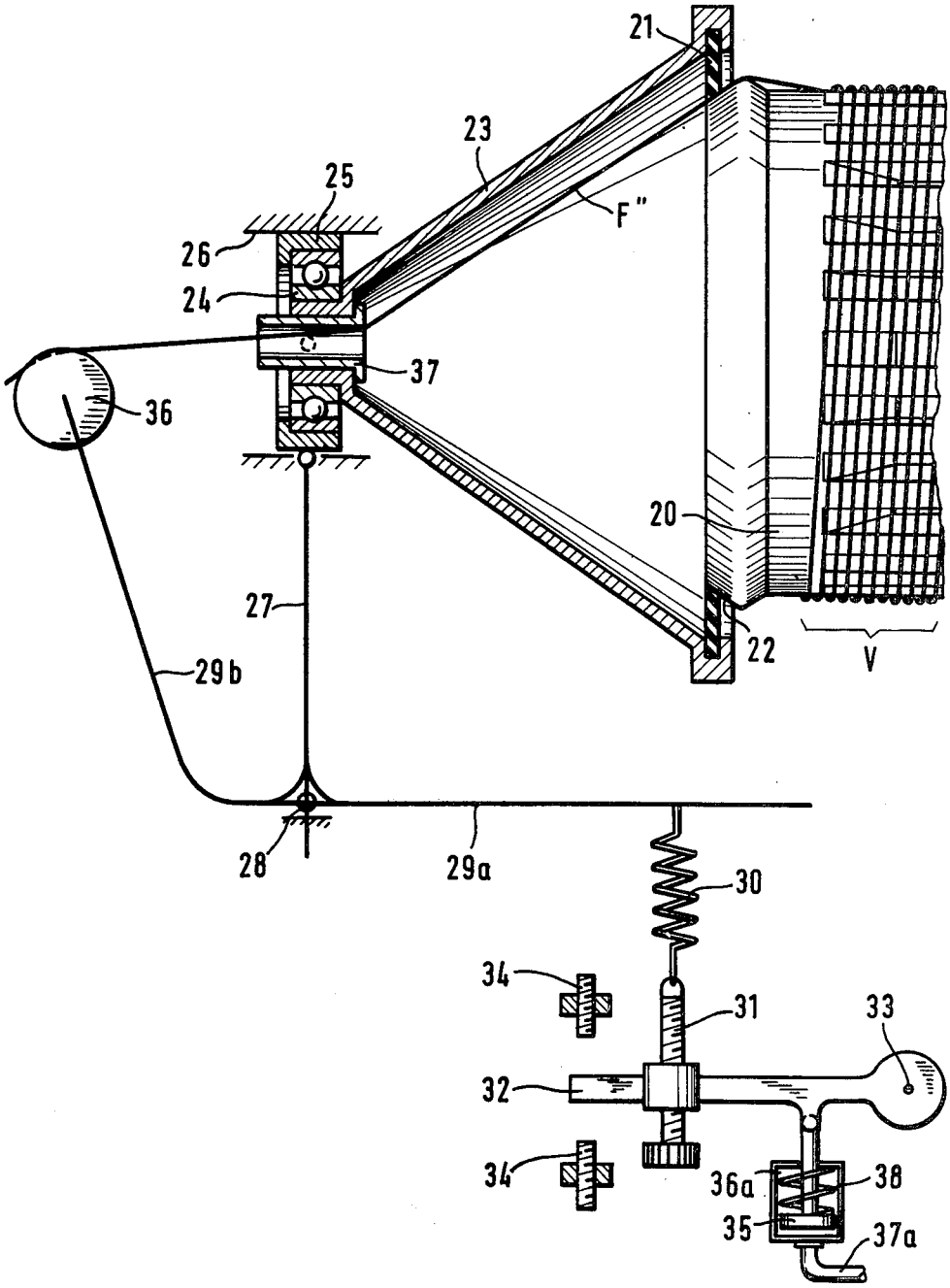
21
23
25
F"
26
24
37
36
20
27
22
V
29b
28
29a
30
34
31
33
32
34
36a
38
35
37a

THREAD SUPPLY DEVICE

BACKGROUND OF THE INVENTION

This invention relates to a device for supplying textile or metallic threads to a processing device, in which the thread issuing from a storage bobbin is wound tangentially on a storage body and is unwound endwise therefrom beneath a resilient brake ring which abuts a conical support surface and can be adjusted in the axial direction of the storage body relative to the support surface.

By means of the axial adjustment of the brake ring, the distance between this or parts of the same, e.g. elastic tongues, bristles or the like, varies relative to the conical support surface. Thus, the pressure with which the ring or its parts abut on the support surface varies as well. The braking effect changes proportionally, i.e. it increases or decreases, and can thus be adapted to different thread material and to different manufacturing processes.

Such a device is known which comprises a brake ring which is supported from the inside against the wall of a conical balloon catch reel which encompasses the unwinding area of the drum.

The brake ring is connected with an axially reciprocable and fixable ring. Displacing and fixing in the interior of the balloon catch reel, which tapers conically toward the opening, is troublesome and time-consuming and, under certain circumstances, necessitates the removal of the balloon catch reel. Displacement thus can occur only during setting prior to the beginning of operation. Subsequent adjustment during operation requires an interruption of work and thus entails a considerable loss of time.

Another device is known which is designed especially for weaving machines. During the weaving operation, greatly fluctuating differences develop with respect to the thread tension. The known device has, at the end of the thread drum, a conically tapering support surface for the threads of a brake ring whose bristles extend inwardly approximately radially to the drum axis. The brake ring is rotatable about the drum to a limited extent and is displaceable axially thereto such that it has screws projecting on its periphery which are guided in longitudinal slots running approximately spirally to the drum axis. Each rotary movement of the ring necessitates a simultaneous axial movement. Two embodiments are provided for the displacement of the brake ring. In the case of the first embodiment, adjustment is by hand by means of a handle which projects radially outwardly from the ring, as well as a set screw which fixes the set position. The thread supply is adapted to the requirements of the weaving machine by means of elements disposed in the continued thread path relative to the machine. In the case of the second embodiment, the radially projecting handle is connected with a hinged arm whose other end rotates a feeler roll and is supported by this feeler roll in a spring-loaded manner against a cam plate. The cam plate in turn is connected with the weaving machine and executes one complete revolution during each stroke of the weaving tool. It is designed such that during the woof movement of the weaving tool, it brings the brake ring into the position over the handle in which the bristles thereof abut only slightly or not at all on the support surface, whilst upon conclusion of the woof movement the ring is brought into an axial position in which the bristles abut on the conical surface with an increased braking effect. The brake ring is thus reciprocated twice during each work cycle with a forward and return stroke, both the time of movement as well as the path of movement being predetermined and invariable due to the cam plate. Additional elements are disposed in the path of thread removal for further adaptation of the thread tension. No further adaptations to the thread tension for the brake ring are possible during the work cycle.

The object of the instant invention is to provide a device of the type described at the outset which uses simple means to facilitate the automatic adjustment of the brake ring to continuously adapt the thread tension to arbitrary conditions of operation. This operation is accomplished in accordance with the invention in that the adjusting means can be actuated in response to the thread tension. The device in accordance with the invention makes it possible to automatically change the braking effect of the brake ring at any arbitrary time during operation and to any arbitrary degree within the scope of the given construction. This ensures the greatest possible adaptation to the respective operating situations, without stopping the machine and without external intervention. Adjustment is not limited to a rigid rhythm and area of movement set to a very specific work cycle. The device is thus suitable for various processing machines which process thread or thread-like material.

Other advantageous features and details of the invention will become evident from the following description of an embodiment of the invention.

BRIEF DESCRIPTION OF THE DRAWING

The single FIGURE of the drawing shows a partial sectional view of a thread supply device in accordance with the invention, which device otherwise corresponds to U.S. Pat. No. 3,419,225, for example.

DETAILED DESCRIPTION

This supply device is especially suitable for thin metallic threads, but can also be used of course for textile threads. One part of a cylindrical storage body 20 is shown which can be set in rotation by means not shown. This can be the storage body of a thread supply device as illustrated in U.S. Pat. No. 3,419,225. A thread is wound upon this storage body tangentially in order to form a thread storage V which is maintained within certain limits by known means. The thread leaves the storage body 20 at F″ axially over the one end. An elastic synthetic rubber disc is provided as the brake ring 21, which ring abuts with its inner edge annularly on the free end of the storage body 20 which is formed as a conically tapering support surface 22. The internal diameter of the brake ring 21 is dimensioned such that there is a slight pressure force between the support surface 22 and the brake ring 21 when the ring 21 is positioned adjacent the end of the support surface 22 having the smaller diameter, as in the illustrated position. This pressure force becomes greater the closer the brake ring 21 approaches the end of the support surface 22 with the greater diameter. Since the thread must pass between the edge of the brake ring 21 and the support surface 22, tension is imparted to the thread which is necessarily dependent on the relative axial position of the brake ring 21 with respect to the support surface 22.

The brake ring 21 is supported in the wide end of a funnel 23 whose narrow end is located in a rolling bearing 24. This rolling bearing 24 is in turn supported in a sliding sleeve 25 which is displaceable in a stationary sliding bearing 26 axially along the axis of the storage body 20. A sliding lever 27 supported in a stationary pivotal bearing at 28 is articulated on the sliding sleeve 25. A two-armed adjusting lever 29a, 29b is rigidly connected with the sliding lever 27. An adjustable tension spring 30 engages the lever arm 29a of the adjusting lever and its other end is connected with a set screw 31 which, in the simplest case, is located in a stationary body (not shown).

A tension feeler roll 36 embraced in part by the unwinding thread F″ is positioned at the free end of the other lever arm 29b. The unwinding thread moves from the support surface 22 through said funnel 23 into an unwinding eye 37 in the narrow end thereof and from here to the tension feeler roll 36.

OPERATION

As long as the thread tension is constant, the forces acting on the sliding lever 27 are in equilibrium. On the other hand, the tension of the unwinding thread F″ sensed by the tension feeler roll 36 acts on lever 27 via the lever arm 29b, while on the other hand the spring 30 acts on the sliding lever 27 via the lever arm 29a. If the tension falls, the sliding lever 27 pivots clockwise due to the spring return force acting on lever arm 29a, thereby sliding the funnel 23 together with the brake ring 21 to the right in the drawing so that the brake ring moves in an area of the support surface 22 with a larger diameter. This increases the pressure force, thus leading to a corresponding increase in thread tension, thereby compensating for the drop in thread tension.

In the reverse case, when the tension of the unwinding thread F″ increases, this tension acting on roller 36 causes a counterclockwise pivoting of lever 27 so that the brake ring 21 is pushed to the left in the drawing, thereby reducing the braking effect and lowering the thread tension.

In this way fluctuations in the thread tension can be continuously and automatically compensated and the unwinding tension is automatically maintained at a substantially constant value.

The desired theoretical tension can be preselected by setting the tension of the spring 30.

The lever 27 can, of course, be regulated directly by the machine consuming the thread. This is the case illustrated in the drawing. The body in which the set screw 31 is located is not stationary in this case, but rather is connected with a single-armed control lever 32. This control lever 32 is pivotally supported in a stationary bearing 33. Its pivotal path is restricted by means of adjustable stops 34. It is connected with a plunger 35 which is disposed in a cylinder 36a which can be pneumatically actuated, for example. The pressure in this cylinder 36a is regulated by the thread-or wire-consuming machine via a pressurized air line 37a. When this machine requires a lower thread or wire tension, the pressure in the cylinder 36a is increased via the line 37a, thereby moving the plunger 35 upwardly against the action of a spring 38 and the control lever 32 pivots clockwise. The lever 27 is thus moved to the left. When the machine again requires a higher thread or wire tension, the pressure in the cylinder 36 is reduced again, with the lever 27 thus being displaced to the right.

The thread supply device with its annular brake disc is especially suitable — as mentioned above — for supplying fine metallic threads, e.g. copper wires, to which an unwinding tension between 7 and 400 grams is to be imparted.

The invention is not limited to the above embodiments. In particular, other optional elastic brake rings may also be employed. Furthermore, they may be adjusted relative to the conical support surface by arbitrary mechanical, electromechanical, hydraulic or pneumatic means as long as the displacement of the elastic brake ring in the axial direction of the storage body is regulated or controlled by the thread tension.

The embodiments of the invention in which an exclusive property or privilege is claimed are defined as follows:

1. In a thread supply device having a storage drum on which the thread issuing from a storage bobbin can be tangentially wound and from which the thread can be endwise unwound, the storage drum having a conical brake surface over which the thread passes as it is unwound endwise from the drum, and resilient brake ring positioned in surrounding relationship to the brake surface and movable axially relative thereof for varying the contact brake pressure between the brake ring and the brake surface, the thread as withdrawn endwise of the drum passing between and being engaged by the brake ring and the brake surface, the improvement comprising adjusting means coacting between the brake ring and the withdrawn thread for automatically axially moving said brake ring relative to said brake surface in response to variation in the tension of the withdrawn thread downstream of the brake ring, said adjusting means causing the braking pressure between the brake surface and the brake ring to be increased in response to a decrease in the tension of the withdrawn thread, and vice versa.

2. A device according to claim 1, wherein the adjusting means includes mounting means movably supporting the brake ring for axial displacement thereof in a direction substantially parallel with the axis of the storage drum, means coacting with said mounting means for imposing a return force thereon for causing axial displacement of the brake ring in a direction toward the large diameter end of the conical brake surface when the tension in the withdrawn thread falls below a predetermined value, and sensing means coupled with said mounting means and positioned for sensing the tension of the withdrawn thread such that the brake ring is moved axially toward the small diameter end of the conical brake surface when the tension in the withdrawn thread exceeds a preselected value, whereby movement of the brake ring toward the large and small diameter ends of the brake surface results in the braking pressure between the brake ring and the brake surface being increased and decreased, respectively.

3. A device according to claim 2, wherein the mounting means comprises a funnel-like element which is coaxially aligned with the storage drum and is provided with mounting structure adjacent the large diameter end thereof for supporting the brake ring in surrounding relationship to the conical brake surface, said funnel-like element being provided with a thread eye at its small diameter end, whereby the withdrawn thread after passing between the brake ring and the brake surfaces passes internally through the funnel-like element and is discharged outwardly through that thread eye formed at the small diameter end thereof.

4. A device according to claim 3, wherein said funnel-like element is mounted for slidable movement with respect to the storage drum in a direction coaxial there-with, and said adjusting means further including lever means supported for pivotal movement and interconnected to said funnel-like element for causing axial displacement thereof, said lever means including a plurality of rigidly interconnected lever arms, one of said lever arms being provided with a tension feeler roller mounted thereon and positioned in engagement with the withdrawn thread at a location disposed downstream of the thread eye for sensing the tension in said withdrawn thread, and said return force means acting on said lever means for causing swinging movement thereof in a direction opposite to that caused by the thread tension imposed on the tension feeler roller.

5. A device according to claim 4, wherein the return force means includes adjustment means for selectively varying the magnitude of the return force imposed on said lever means.

6. A device according to claim 3, wherein said adjusting means includes movable link means connected to said funnel-like element for causing limited axial displacement thereof in a direction which is substantially coaxially aligned with the storage drum, and a tension sensing element mounted on said link means and positioned in engagement with the withdrawn thread at a location disposed downstream of the thread eye.

7. A device according to claim 1, wherein said adjusting means includes a thread sensing element disposed in engagement with the withdrawn thread at a location disposed downstream of said brake ring for the tension in said withdrawn thread, and said adjusting means also including movable linkage means operatively connected between said sensing element and said brake ring for causing displacement of said brake ring in response to a corresponding movement of said sensing element.

8. A device according to claim 7, wherein said linkage means comprises lever means supported for pivotal movement about a pivot axis which extends substantially perpendicular to the longitudinally extending axis of said storage drum, said lever means having said thread sensing element mounted thereon in radially spaced relationship from said pivot axis, and said lever means being interconnected to said brake ring for causing axial displacement thereof in a direction coaxial with said storage drum upon pivotal movement of said lever means.

9. A device according to claim 8, including means defining a thread eyelet positioned in substantially coaxial alignment with said storage drum, said thread eyelet being spaced axially from the brake ring so that the withdrawn thread after passing beneath said brake ring then passes through said thread eyelet, and said thread sensing element being disposed for engagement with the withdrawn thread at a location disposed downstream of said thread eyelet.

10. A device according to claim 8, wherein said adjusting means includes spring means for normally imposing a restoring force which tends to move said brake ring in an axial direction which is opposite to that movement caused by increases in the thread tension.

11. A device according to claim 7, wherein said adjusting means also includes spring means coacting with said linkage means and tending to move same in a direction which opposes the movement thereof as caused by an increase in the thread tension.

* * * * *

UNITED STATES PATENT AND TRADEMARK OFFICE

CERTIFICATE OF CORRECTION

PATENT NO. : 4 068 807

DATED : January 17, 1978

INVENTOR(S) : Kurt Arne Gunnar Jacobsson

It is certified that error appears in the above-identified patent and that said Letters Patent are hereby corrected as shown below:

Column 4, Line 19; after "and" insert ---a---.

Column 4, Line 64; change "that" to ---the---.

Column 5, Line 30; after "for" insert ---sensing.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*